US006701764B2

(12) United States Patent
Bruck et al.

(10) Patent No.: US 6,701,764 B2
(45) Date of Patent: Mar. 9, 2004

(54) METHOD OF EXPANDING AN INTERMEDIATE PORTION OF A TUBE USING AN OUTWARD RADIAL FORCE

(75) Inventors: Gerald J. Bruck, Murrysville, PA (US); Eugene E. Smeltzer, Export, PA (US); Francis A. Kramer, Allison Park, PA (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 237 days.

(21) Appl. No.: 09/965,713

(22) Filed: Sep. 27, 2001

(65) Prior Publication Data

US 2003/0056560 A1 Mar. 27, 2003

(51) Int. Cl.[7] ..... B21D 9/15; B21D 17/00; B21D 39/08

(52) U.S. Cl. ..... 72/62; 72/58; 72/61; 29/421.1

(58) Field of Search ..... 72/54, 55, 56, 72/57, 58, 59, 60, 61, 62, 63; 29/421.1

(56) References Cited

U.S. PATENT DOCUMENTS

| | | | | | |
|---|---|---|---|---|---|
| 3,718,426 | A | | 2/1973 | Harris | |
| 4,567,631 | A | * | 2/1986 | Kelly | 72/58 |
| 4,580,427 | A | * | 4/1986 | Akamatsu | 72/62 |
| 4,607,426 | A | * | 8/1986 | Kelly | 26/421.1 |
| 5,058,408 | A | * | 10/1991 | Leftault, Jr. et al. | 72/56 |
| 5,419,791 | A | * | 5/1995 | Folmer | 72/61 |
| 5,776,270 | A | * | 7/1998 | Biondich | 72/56 |
| 5,813,266 | A | * | 9/1998 | Ash | 72/57 |
| 5,823,034 | A | * | 10/1998 | Nelepovitz | 72/60 |
| 6,174,159 | B1 | | 1/2001 | Smith et al. | |
| 6,322,645 | B1 | * | 11/2001 | Dykstra et al. | 72/62 |
| 6,349,583 | B1 | * | 2/2002 | Kleinschmidt et al. | 72/62 |
| 6,564,606 | B2 | * | 5/2003 | Okada et al. | 72/59 |

FOREIGN PATENT DOCUMENTS

| | | |
|---|---|---|
| DE | 1915304 | 10/1969 |

* cited by examiner

*Primary Examiner*—David B Jones

(57) ABSTRACT

A method of making a tube having an expanded region which includes the steps of providing an elongated metal tube, preparing the tube to be expanded, and, exerting a generally uniform outwardly radial force to create the expanded region. During the preparation step, a region of the tube is annealed by applying heat. The outward radial force may be created by pressurizing the tube, by freezing water within the tube or by axially rotating the tube.

11 Claims, 9 Drawing Sheets

METHOD OF EXPANDING AN INTERMEDIATE PORTION OF A TUBE USING AN OUTWARD RADIAL FORCE

BACKGROUND OF THE INVENTION

1. Field of the Invention

This invention relates to a method of creating an expanded region on a tube, and more specifically, to a method of using an inserted material to create an expanded region on cooling tubes for a catalytic combustor for a combustion turbine so that the cooling tubes maintain contact with one another and dampen vibration.

2. Background Information

Combustion turbines, generally, have three main assemblies: a compressor assembly, a combustor assembly, and a turbine assembly. In operation, the compressor compresses ambient air. The compressed air flows into the combustor assembly where it is mixed with a fuel. The fuel and compressed air mixture is ignited creating a heated working gas. The heated working gas is expanded through the turbine assembly. The turbine assembly includes a plurality of stationary vanes and rotating blades. The rotating blades are coupled to a central shaft. The expansion of the working gas through the turbine section forces the blades, and therefore the shaft, to rotate. The shaft may be connected to a generator.

Typically, the combustor assembly creates a working gas at a temperature between 2,500 to 2,900 degrees Fahrenheit (1371 to 1593 degrees centigrade). At high temperatures, particularly above about 1,500 degrees centigrade, the oxygen and nitrogen within the working gas combine to form the pollutants NO and $NO_2$, collectively known as NOx. The formation rate of NOx increases exponentially with flame temperature. Thus, for a given engine working gas temperature, the minimum NOx will be created by the combustor assembly when the flame is at a uniform temperature, that is, there are no hot spots in the combustor assembly. This is accomplished by premixing all of the fuel with all of the of air available for combustion (referred to as low NOx lean-premix combustion) so that the flame temperature within the combustor assembly is uniform and the NOx production is reduced.

Lean pre-mixed flames are generally less stabile than non-well-mixed flames, as the high temperature regions of non-well-mixed flames add to a flame's stability. One method of stabilizing lean premixed flames is to react some of the fuel/air mixture in conjunction with a catalyst prior to the combustion zone. To utilize the catalyst, a fuel/air mixture is passed over a catalyst material, or catalyst bed, causing a pre-reaction of a portion of the mixture and creating radicals which aid in stabilizing combustion at a downstream location within the combustor assembly.

Prior art catalytic combustors completely mix the fuel and the air prior to the catalyst. This provides a fuel lean mixture to the catalyst. However, with a fuel lean mixture, typical catalyst materials are not active at compressor discharge temperatures. As such, a preburner is required to heat the air prior to the catalyst adding cost and complexity to the design as well as generating NOx emissions, See e.g., U.S. Pat. No. 5,826,429. It is, therefore, desirable to have a combustor assembly that bums a fuel lean mixture, so that NOx is reduced, but passes a fuel rich mixture through the catalyst bed so that a preburner is not required. The preburner can be eliminated because the fuel rich mixture contains sufficient mixture strength, without being preheated, to activate the catalyst and create the necessary radicals to maintain a steady flame, when subjected to compressor discharge temperatures. As shown in U.S. patent application Ser. No. 09-670,035, which is incorporated by reference, this is accomplished by splitting the flow of compressed air through the combustor. One flow stream is mixed with fuel, as a fuel rich mixture, and passed over the catalyst bed. The other flow stream may be used to cool the catalyst bed.

One disadvantage of using a catalyst is that the catalyst is subject to degradation when exposed to high temperatures. High temperatures may be created by the reaction between the catalyst and the fuel, pre-ignition within the catalyst bed, and/or flashback ignition from the downstream combustion zone extending into the catalyst bed. To reduce the temperature within the catalyst bed, prior art included a plurality of closely-oriented, parallel cooling tubes. These cooling tubes were susceptible to vibration because they were cantilevered, being connected to a tube sheet at their upstream ends. The inner surface of the cooling tubes were free of the catalyst material and allowed a portion of the compressed air to pass, unreacted, through the cooling tubes. The fuel/air mixture passed over the tubes, and reacted with, the catalyst bed. Then, the compressed air and the fuel/air mixture were combined. The compressed air absorbed heat created by the reaction of the fuel with the catalyst and/or any ignition or flashback within the catalyst bed. See U.S. patent application Ser. No. 09-670,035.

The disadvantage of such cooling systems was susceptibility of the tubular configuration to vibration damage resulting from: (1) flow of cooling air inside of the tubes, (2) flow of the fuel/air mixture passing over the tubes transverse and longitudinal to the tube bundle, and (3) other system/engine vibrations. Such vibration has caused problems in the power generation field, including but not limited to: degradation of connecting joints (e.g. brazing of the cooling conduits to the tubesheet); deformations due to tube to tube or tube to support structure impacting; and premature ignition, known as backflash, which results from irregular and reverse flow around and through the cooling conduits. Moreover, vibration of the cooling conduits or tubes, must be eliminated to prevent insufficient cooling, improper fuel reactions and even physical damage to the structural elements of the combustor.

Nonuniform tube expansion and overall tube expansion has been achieved by mechanical methods as propelling a ball through the overall tube length, pressing a pointed die in the end of tube to flare the end, and expanding a collet within the tube body. Each of these prior methods of tube expansion has its own shortcomings and none can achieve localized, uniform expansion. The collet approach is limited in that uniform expansion is not achieved and localized cracking of the tube wall may result. Pressing a pointed die in the end of the tube, if exactly centered, can produce a simple conical flare at the end of a tube but cannot achieve more complex shapes such as bulges. Propelling a ball through the tube has been successfully used in overall tube expansion but is ineffective in localized bulging or flaring of tubes.

None of the existing methods of tube expansion can achieve the localized and uniform tubular expansions at an intermediate portion of the tube necessary to suppress vibration of the parallel cooling conduits within a catalytic combustor.

There is, therefore, a need for an effective method of making uniform, localized expanded regions, or "bulges," on the intermediate portions of a cooling tube for a catalytic reactor assembly of a combustion turbine.

There is further a need for a method of assembling the catalytic combustor so that the plurality of bulged cooling tubes contact one another thus suppressing vibration and minimizing degradation of the assembly.

SUMMARY OF THE INVENTION

These needs, and others, are met by the instant invention, which provides a method to create uniform localized expansions on the intermediate portion of a cooling tube. In turn, the tubes, whether assembled so that the expansion on one tube contacts the expansions on adjacent tubes, or so that the expansions on one tube are staggered with respect to the expansions on adjacent tubes thus contacting the unexpanded regions of that tube, create a dampening device by maintaining tube to tube contact and minimizing vibration.

The preferred method of expanding tubes utilizes a combination of localized softening of the tube by applying an annealing heat treatment followed by internal pressurization of a fluid to create an outward radial force. One way of providing such internal pressurization is hydraulically, by filling a tube with hydraulic fluid, sealing it, and then applying pressure using a pump. To avoid cracking the tube from work hardening, this technique may be repeated multiple times, reannealing the tube, and gradually applying greater pressure with each iteration until the desired bulge is formed. Work hardening is the phenomenon in which steel hardens due to cold working or working the steel when it is cool or unannealed. As the steel stretches and hardens it becomes more susceptible to cracking thus necessitating reheating or reannealing between internal pressurization steps. To further refine the process and add precision to the shape and size of the bulges, the tube may be placed in a rigid die having a machined cavity corresponding to the desired bulge.

Alternative hydraulic pressure methods may be employed to bulge the tube. One such method would be to immerse a portion of an annealed tube which has been filled with water and sealed, into a cryogenic liquid, such as liquid nitrogen, until the water freezes. As the water freezes, the fluid water is compressed, thereby increasing pressure in the tube. Also, if the tube remains in contact with the cryogenic liquid, ice may form within the annealed portion of the tube. As the water freezes and expands, the annealed portion of the tube is expanded. Expansion could also be achieved by other methods of internal pressurization, including but not limited to pneumatic pressurization and heat treatment of a solid insert with a higher coefficient of thermal expansion.

This method of forming expanded regions may also be performed after the tubes are attached to the tube sheet. That is, an intermediate portion of each tube is first given an annealing heat treatment and then the tubes are attached to the tube sheet as is known in the prior art, forming a tube sheet assembly. Each tube has one end plugged and is then filled with water. The other end of each tube is then plugged. One end of the tube sheet assembly is then dipped in a cryogenic fluid. As the water in the tube freezes, the annealed portion of each tube will bulge until it contacts an adjacent tube. Thus, because the tubes expand to each other, the size of each expansion does not need to be rigidly controlled.

It is an object of this invention to provide a method of forming at least one generally uniform, localized expansion on a cooling tube for a catalytic combustor.

It is further an object of this invention to provide a method of forming various expansion lengths, widths and heights on a cooling tube for a catalytic combustor.

A still further object of this invention is to provide a method of assembling a catalytic combustor assembly so that the cooling tubes, having an expanded region, contact one another, thus suppressing vibration.

BRIEF DESCRIPTION OF THE DRAWINGS

A full understanding of the invention can be gained from the following description of the preferred embodiments when read in conjunction with the accompanying drawings in which:

FIG. 3A shows the tube being annealed, FIG. 3B shows a tube plugged on one end being filled with a fluid, FIG. 3C shows a tube plugged on both ends being inserted into a die, and FIG. 3D shows the tube connected to a pump.

FIG. 4A shows the tube being annealed, FIG. 4B shows a tube plugged on one end being filled with water, FIG. 4C shows a tube plugged on both ends being inserted into a cryogenic liquid bath.

FIG. 5A shows the tubes being annealed. FIG. 5B shows plugged tubes coupled to a tube sheet being filled with water while the side walls, the inner shell and the inner wall of the core are attached to the tube sheet. FIG. 5C shows the core after being dipped into a cryogenic liquid bath.

FIG. 6A shows a mass of solid material having a different coefficient of thermal expansion being inserted into the tube. FIG. 6B shows both the tube and the mass being heated. FIG. 6C shows the tube in a die/vacuum chamber.

DETAILED DESCRIPTION OF THE PREFERRED EMBODIMENT

Figure 1:
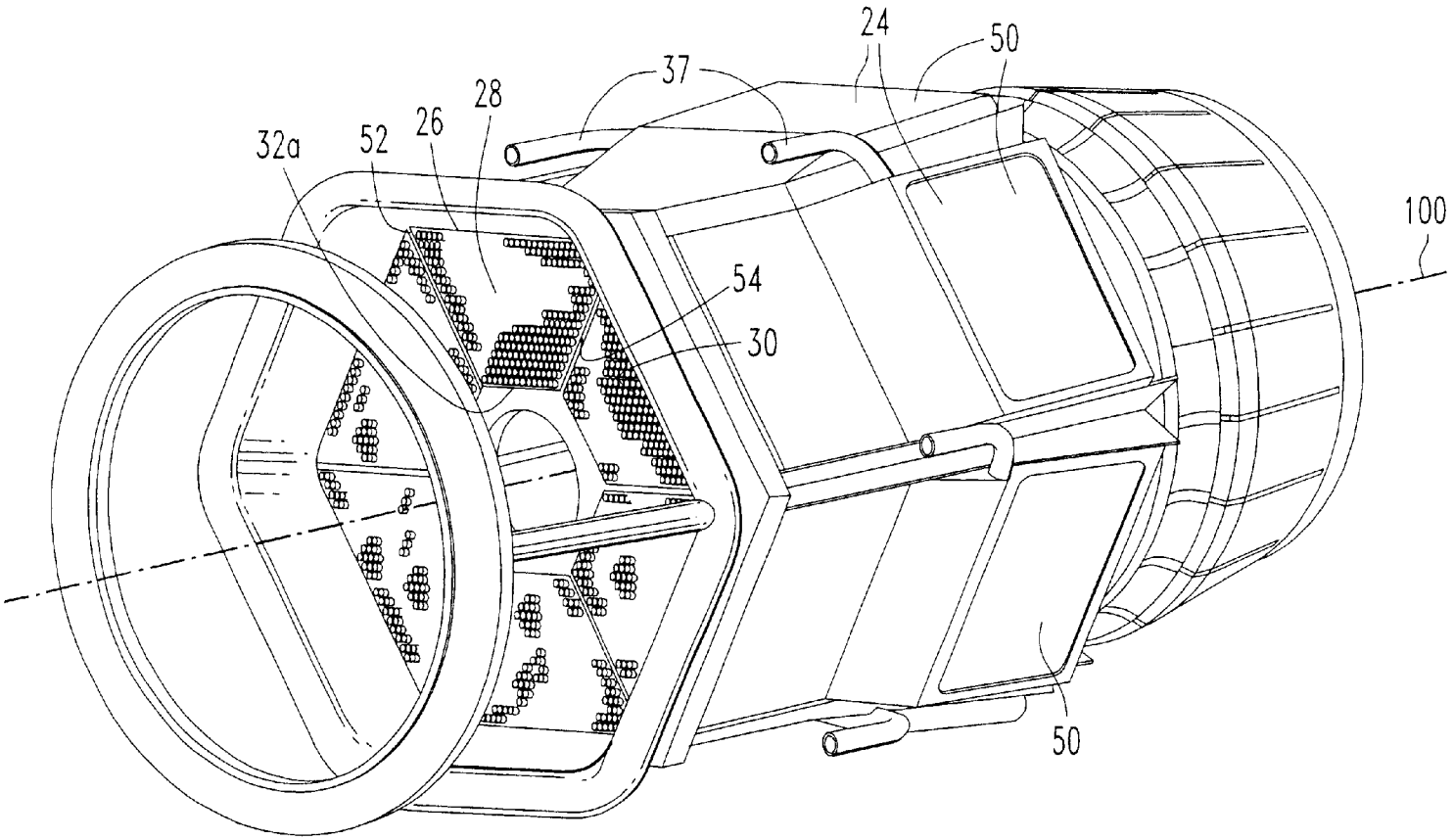
FIG. 1 is an isometric view showing a catalytic combustor having six modules housing a plurality of cooling tubes disposed about a central axis in a generally hexagonal orientation.
Figure 2A:
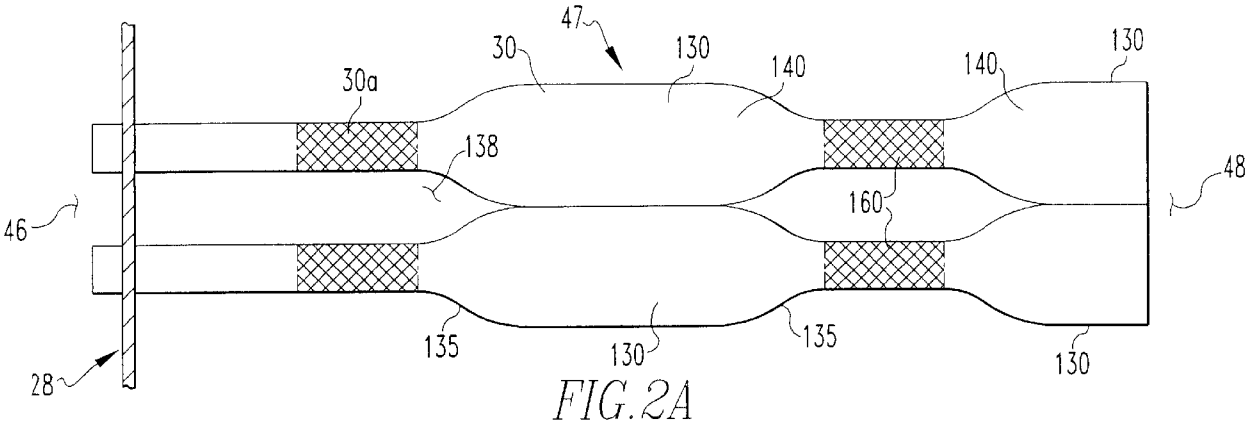
FIG. 2A is a side view of a pair of cooling tubes for a catalytic combustor module each having expanded regions which are structured to contact each other.
Figure 2B:
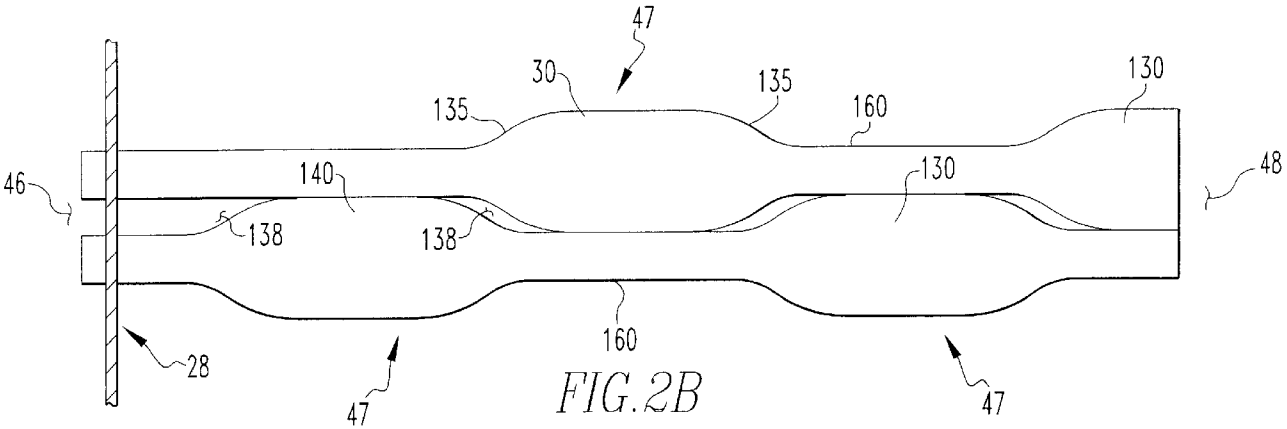
FIG. 2B is a side view of a pair of cooling tubes for a catalytic combustor module having staggered expanded sections so that the expanded regions on one tube contact the narrow regions on an adjacent tube.

As shown in FIG. 1, a catalytic reactor assembly is often separated into modules 50 that are disposed about a central axis 100. Each module 50 includes an outer shell 24, an inner shell 26, a tube sheet 28, a fuel inlet 37, an inner wall 32 and sidewalls 52, 54. A plurality of cooling tubes 30 are enclosed by inner shell 26, inner wall 32 and sidewalls 52, 54. The tubes 30 have a first end 46, an intermediate portion 47, and a second end 48 (FIG. 2). As used herein, the intermediate portion 47 is located anywhere between, and spaced from, the first and second ends 46, 48. The rhomboid tube sheet 28 is coupled to the inner shell 26, inner wall 32 and sidewalls 52, 54 of the upstream end of the module 50 by a fastening process (e.g. brazing). The tube sheet 28 is perforated and supports a plurality of cooling tubes 30. The tube sheet 28, the tubes 30, the inner shell 26, the inner wall 32 and sidewalls 52, 54 form the core 56 of the module 50. As shown, six modules 50 form a generally hexagonal cluster about the central axis 100. Of course, any number of modules 50 of various shapes could be used.

The outer shell 24 and the inner shell 26 form a first plenum. This plenum is open to an air source. Typically, the catalytic reactor assembly 1 is part of a combustor assembly for a compressor-turbine. The combustor assembly is in fluid communication with compressed air from the compressor. A portion of compressed air flows through the first plenum. Fuel lines 37 supply fuel to the first plenum. When the fuel is mixed with air in the first plenum, a fuel/air mixture is created.

The inner shell 26, sidewalls 52, 54, inner wall 32, and the tube sheet 28 form a fuel/air plenum. The cooling tubes 30 extend through the fuel/air plenum. The inner surface of the fuel/air plenum, including the outer side of the cooling tubes 30, is coated with a catalytic material 30*a* (FIG. 2). The first plenum and the fuel/air plenum are in fluid communication. In operation, the fuel/air mixture travels from the first plenum to the fuel/air plenum, where the fuel reacts with the catalytic material 30*a*. Another portion of compressed air from the compressor passes through the cooling tubes 30 and absorbs heat from the catalytic reaction.

To minimize vibration of the cooling tubes 30, a vibration dampening device 120, as shown in FIG. 2, can be used. The dampening device 120 consists of at least one expanded region 140 and at least one narrow region 160 on one or more of the tubes 30. The narrow region 160, in most of the embodiments, is simply the unexpanded part of the tube 30 or the nominal tube circumference. The expanded region 140 permits the plurality of closely oriented and parallel tubes 30 to remain in contact with one another, thus suppressing vibration. The expansion region 140 may have different shapes, as detailed below. In a first embodiment of the apparatus, the expansion region 140 may be a localized expansion 130 of the nominal tube circumference with a gradual transition region 135 between the nominal tube circumference and the center of expansion. As used herein, a "localized expansion" indicates that the entire circumference, or outer periphery, of a tube is expanded as opposed to just a portion of the circumference. The gradual transition 135 and subtle expansion profile 130 are necessary to promote even flow through the module 50 and prevent an excessive pressure drop. The expanded region 140 does not extend the entire length of the tube 30 and there may be more than one expanded region on each tube 30. The catalyst material 30*a* may cover the entire tube 30 or only the narrow regions 160, in which case the contacting expanded regions 140 need not coated. Because the tubes 30 contact each other at the expanded regions 140, the expanded portions at the point of contact are not exposed to the fuel/air mixture. As such, it may be more cost efficient to not coat the expanded regions 140 with the catalyst material 30*a*.

Each tube 30 may have an expansion 140 at the intermediate portion 47 and an expansion 140 at the tube second end 48, which is the downstream end. Both expansions 47, 48 help to generate the desired flow path around the tubes 30 and the desired minimal pressure drop within the module 50. The tubes 30 downstream ends 48 are expanded and each of the expanded regions 140 of one tube 30 contact the expanded regions 140 of the adjacent tubes 30. The catalyst 30*a* is only covering the unexpanded or narrow regions 160 of the tube 30. A flow path 138 between the tubes 30 is created between the contacting localized expansions 130 of the tubes 30 at each location where the narrow region 160 of one tube 30 is opposite the narrow region 160 of the adjacent tube 30.

As shown in FIGS. 3A–3D, the method to create the expanded regions 140 on each tube 30 is to prepare the tube 30 for expansion, insert a material 201 into the tube 30, and then use the material 201 to exert a uniform, generally outwardly radial force until a portion of the prepared tube 30 bulges to form the expanded region 140. There are at least three procedures by which the material 201 can be used to create the uniform, generally outwardly radial force. First, while using a sealed tube, a fluid material 401 can be pressurized to increase the pressure inside the tube 30. Second, again with a sealed tube and when the material is water 402, the water 402 may be frozen. Because water 402 expands as it freezes, the volume inside the tube will increase. Third, a solid material 500 having a greater coefficient of thermal expansion may be placed in the tube and heated.

Preparation of the tube includes the steps of locally softening a first region 140*a* on the intermediate portion 47 of the tube 30 by applying an annealing heat treatment. The heat treatment is applied by a heat source 200, typically a flame. When a fluid material 401 is used, the tube 30 must be sealed with a first and second plug 146, 148. Thus, after annealing the tube 30, one end of the tube 30 is plugged with a first plug 146. Next the fluid material 401 is inserted into the tube 30. As shown in the figure, the fluid material 401 is a liquid, however, the fluid material 401 may also be a gas. The fluid material 401 is selected from the group including air, water, hydraulic fluid, and non-Newtonian fluids. After the fluid material 401 is inserted, the second plug 148 is then placed on the tube 30. Either the first plug 146 or the second plug 148 includes a valve means 149. At this point the tube 30 is prepared.

Figure 3A:
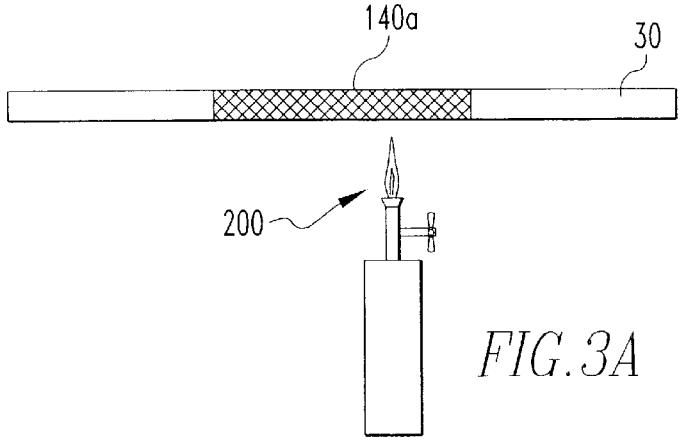
FIGS. 3A–3D show one embodiment of the present method. More specifically.
Figure 3B:
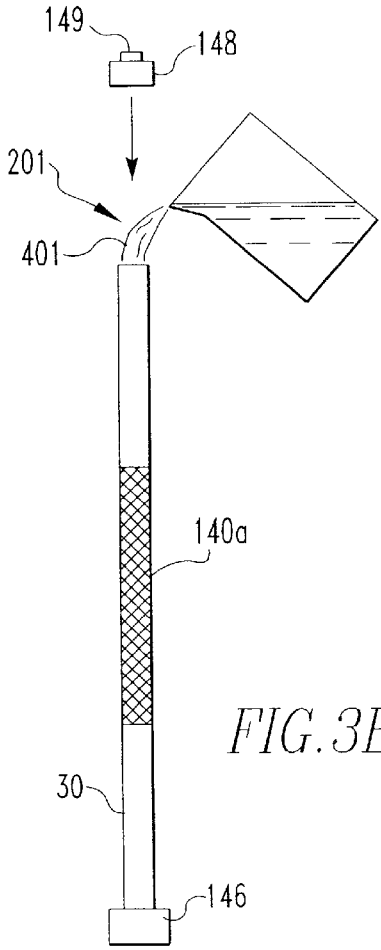
Figure 3C:
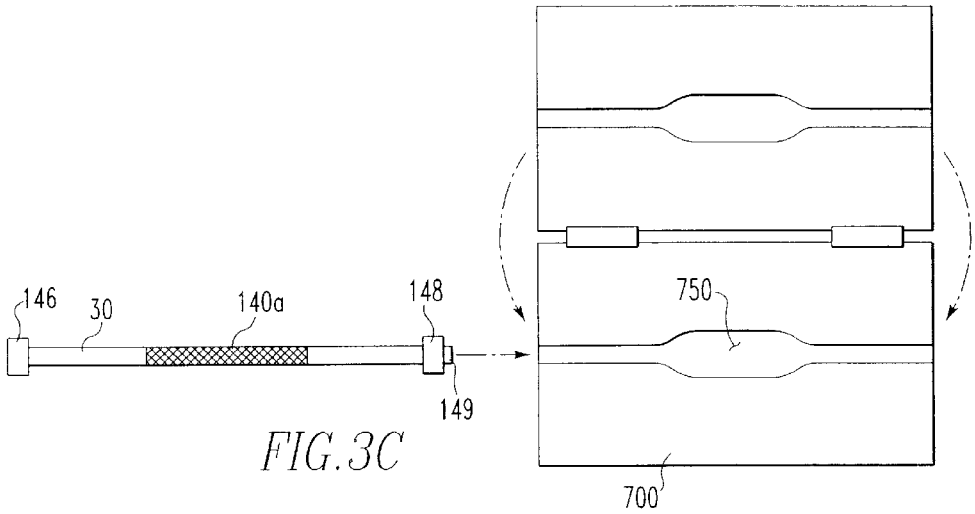
Figure 3D:
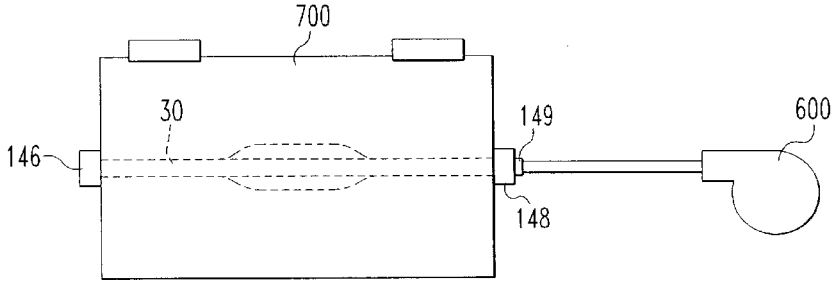

In a first embodiment of the method, the tube 30 is expanded by pressurizing the fluid material 401. As shown in FIG. 3C, the tube 30 is inserted into a rigid die 700 having a machined cavity 750 corresponding to the desired size and shape for the expanded region 140. That is, where a localized expansion 130 is desired, the cavity 750 extends around the entire tube 30. Where, as detailed below, an expanded region 140 having a different shape is desired, the cavity 750 may be machined to that shape. The rigid die 700 permits precise shape and dimension of the expansions 140 as well as uniformity among the expansions 140 of different tubes 30. A pump 600 is attached to the valve means 149. Thus, the pump 600 is in fluid communication with the fluid material 401 in the tube 30. Next, the pump 600 is used to increase the pressure within the tube 30. As the pressure within the tube 30 increases, the first region 140*a* which has been annealed is expanded. The entire process, the heating step, and/or just the pressurizing step, can be repeated as many times as necessary to gradually form the desired expanded region 140 while avoiding cracking the tube 30 due to work hardening. By way of example, a ten inch long catalytic combustor cooling tube 30 having a nominal initial tube diameter of 0.187 inch requires repetition of this method two times to expand the tube 30 from the initial diameter to a desired expanded region 140 diameter of 0.244 inch. This is the necessary amount of expansion required for the expanded region 140 of one tube 30 to contact the expansions 140 of the adjacent tubes 30.

Figure 4A:
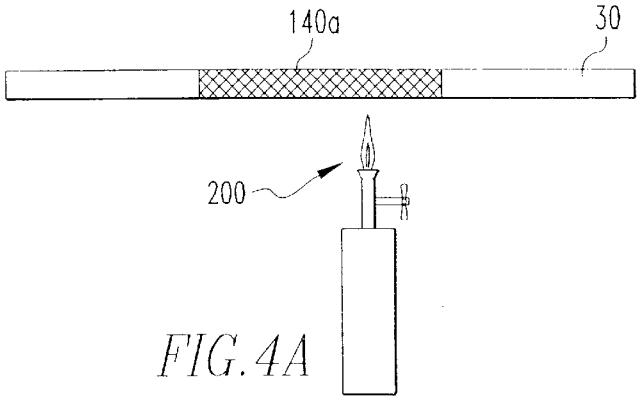
FIGS. 4A–4C show another embodiment of the present method. More specifically.
Figure 4B:
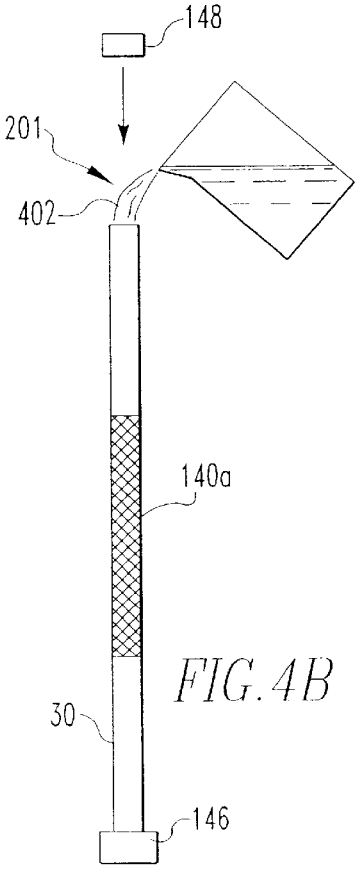
Figure 4C:
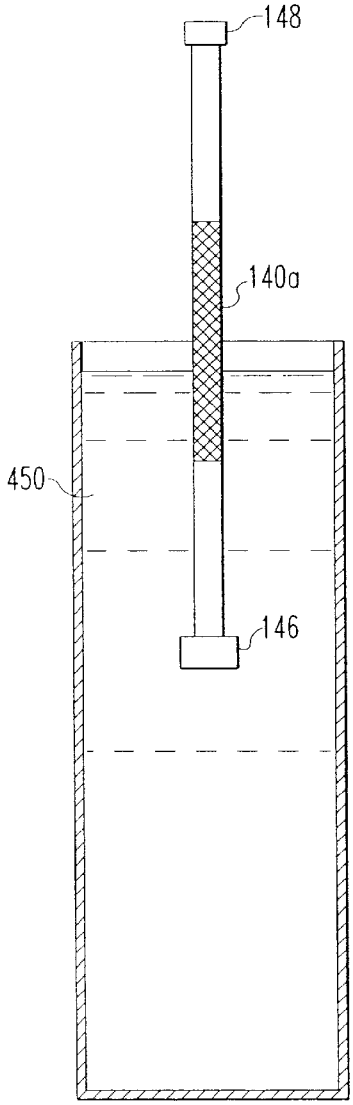

A second embodiment of the method is shown in FIGS. 4A–4C. The tube 30 is prepared as before, that is, heated and plugged and filled as shown in FIGS. 4A and 4B. In this embodiment, the tube must be filled with water 402, as opposed to other fluid materials. Also, in this embodiment, the second plug 148 does not need a valve means 149. After the tube 30 is filled with water 402 and plugged, the tube 30 is partially or entirely immersed in a cryogenic fluid bath 450 for several minutes until the water 402 freezes (FIG. 4C). Preferably, the cryogenic fluid is liquid nitrogen. The water 402 has a coefficient of thermal expansion which is different from the tube 30. As the water 402 freezes, the ice expands. Initially, the expansion of the ice increases the pressure of the water 402 in the tube 30. As the pressure increases, the first region 140*a* on the tube 30 expands. This can be accomplished by partially submerging the tube 30 in the cryogenic fluid bath 450. Alternatively, the tube may be left partially submerged, or may be entirely submerged, in the cryogenic fluid bath 450 until ice forms within the first region 140*a*. As the ice expands in the first region 140*a* an outwardly radial force is created which expands the softened region 140*a* of the tube 30 to form the desired expanded region 140. After the expansion process is complete, the plugs 146, 148 are removed and the water 402 is emptied. This embodiment has the advantage of not requiring a pump 600.

Figure 5A:
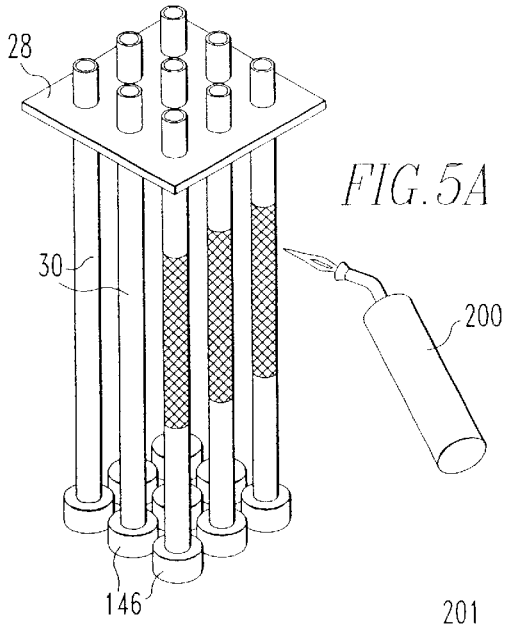
FIGS. 5A–5C show another embodiment of the present method that may be used on a core.
Figure 5B:
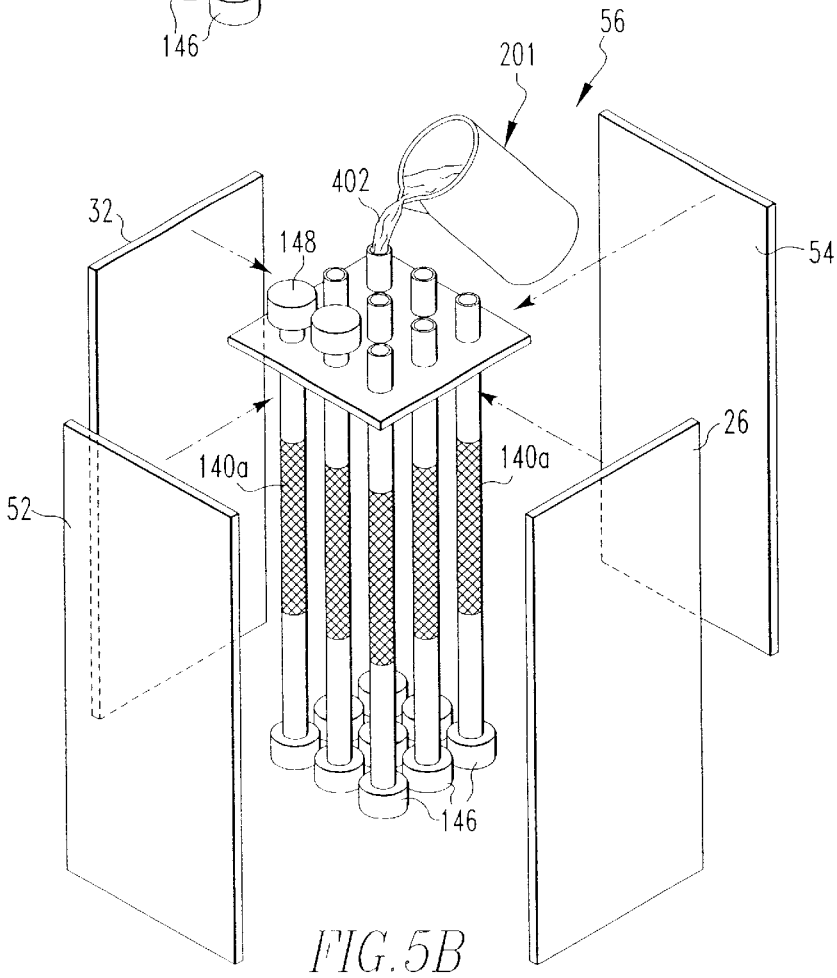
Figure 5C:
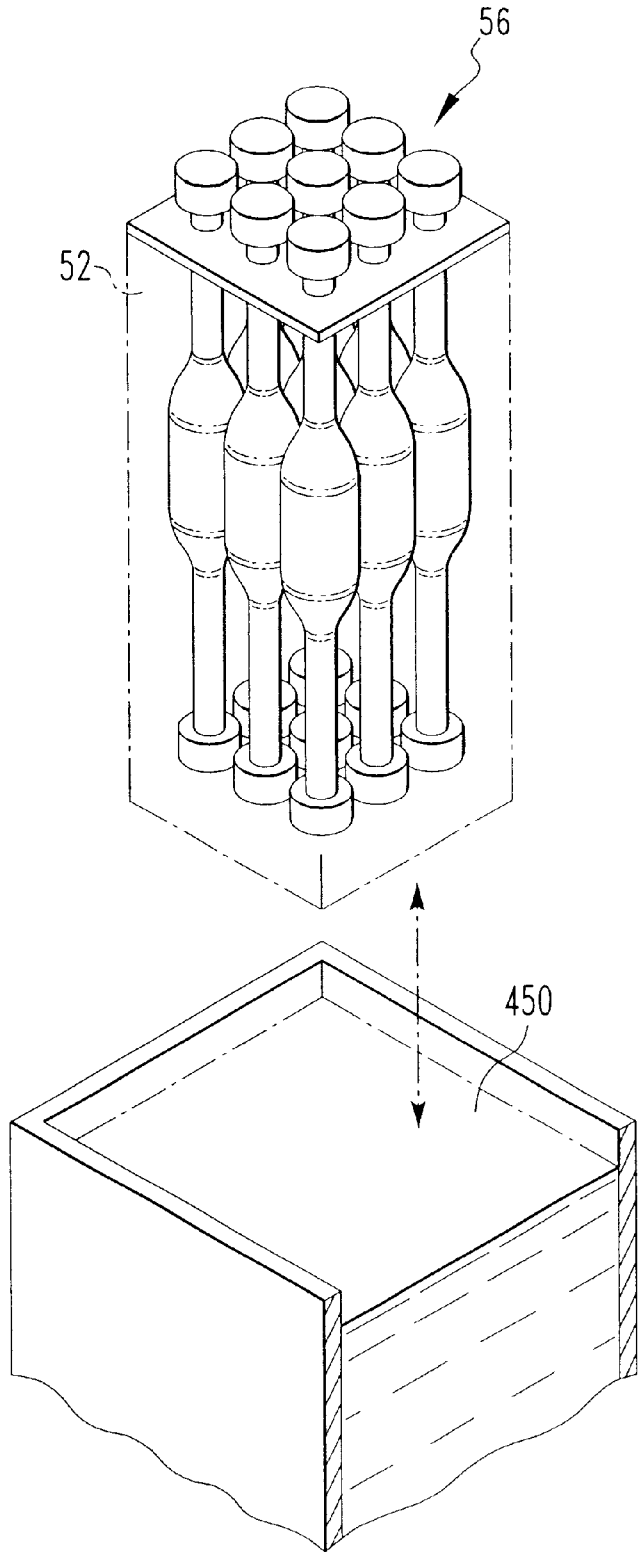

The embodiment of this method using water/ice may also be practiced where the tubes 30 are connected to a tube sheet 28. As shown in FIGS. 5A, the tubes 30 are coupled to the tube sheet 28 as is known in the prior art. As shown in FIGS. 5A and 5B, the tubes 30 are prepared as detailed above, that is, annealed, filled with water and plugged. As shown in FIG. 5B, the tube sheet 28 may then be coupled to the inner shell 26, the inner wall 32, and the side walls 52, 54 to form a core 56. Thus, core 56 forms an enclosure, having one open end, around the tubes 30. As shown in FIG. 5C, the core 56 is then dipped, either partially or entirely, into a cryogenic fluid bath 450. As the water freezes, the pressure within the tubes 30 is increased, the soft first region 140*a* expands. The soft first region 140*a* on each tube will expand until the soft first region 140*a* contacts another tube 30 or the inner shell 26, the inner wall 32, and/or the side walls 52, 54. As such, when using this embodiment of the method, the size and shape of the expanded regions 140 do not have to precisely match each other as contact between the tubes 30 is assured during the freezing process. After the expansion process is complete, the plugs 146, 148 are removed and the water 402 is emptied.

Figure 6A:
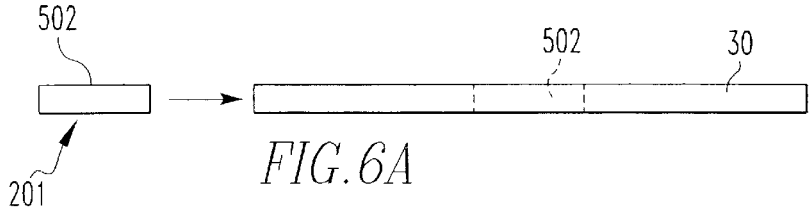
FIGS. 6A–6C show one embodiment of the present method. More specifically.
Figure 6B:
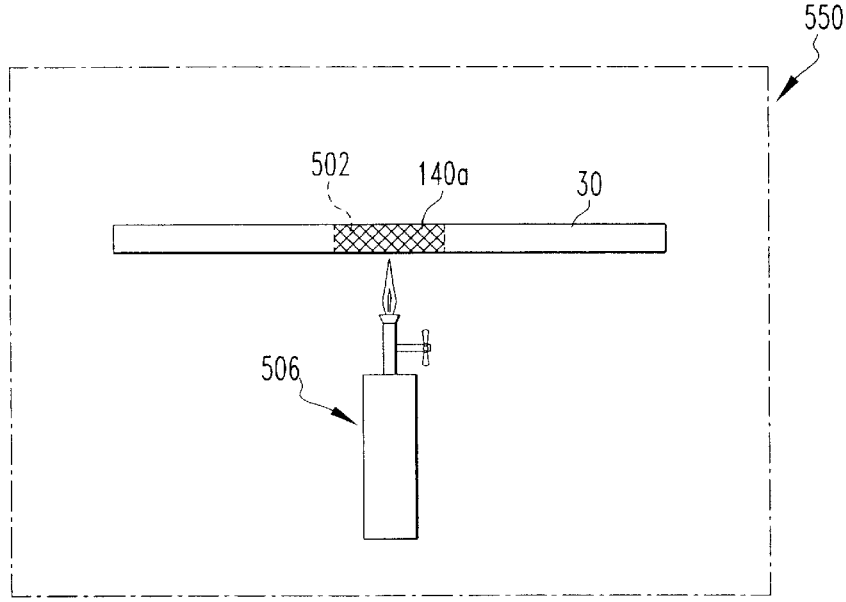
Figure 6C:
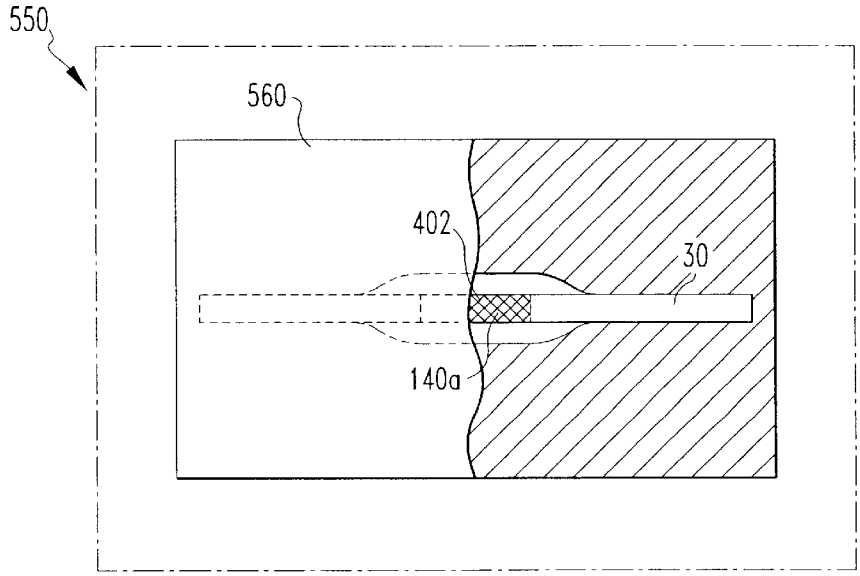

In another embodiment of the method, shown in FIGS. 6A and 6B, the tube 30 is heated, as before, and a mass of solid material 500 having a coefficient of thermal expansion which is different from, that is, greater than, the coefficient of thermal expansion of the material used to form the tube 30 is inserted into the tube 30. As used herein, the word "solid" refers to the state of matter of the material, as opposed to the geometry of the mass 500. That is, the solid mass 500 may have any shape, e.g. a hollow cylinder, so long as the material is a solid. The mass of solid material 500 is shaped to fit snugly within the tube 30. Typically, the tube 30 is made from steel or a steel alloy. The solid material 500 may be a bimetal 502, like NiTi, or a memory metal. The solid material 500 is placed within the soft first region 140*a*. The solid material 500 and the soft first region 140*a* are then heated by a heat source 506. Because the solid material 500 has a greater coefficient of thermal expansion, or, in the case of a shape memory, an inclination to change to an alternate shape when heated, the solid material expands more than the tube 30 creating an outward radial force. Accordingly, the soft first region 140*a* forms an expanded region 140. This embodiment of the method may also utilize a vacuum chamber 550 to assist in bulging the expanded region 140. That is, the tube 30 could also be sealed and placed in a vacuum chamber 550, as shown in FIG. 6B. Furthermore, as shown in FIG. 6C, the vacuum chamber 550 may include a die 560 to precisely control the expanded region 140 size, location and shape.

Figure 7A:
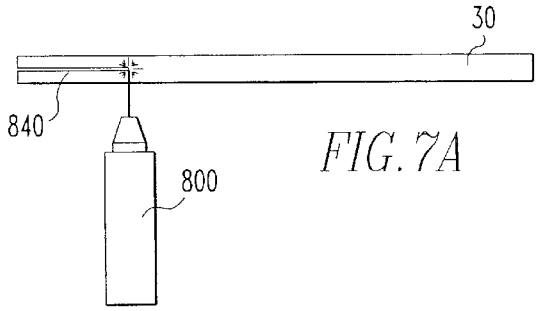
FIG. 7A shows the method of tube expansion employing a laser to anneal a local region in the form of a narrow ridge along the longitudinal axis of the tube.
Figure 7B:
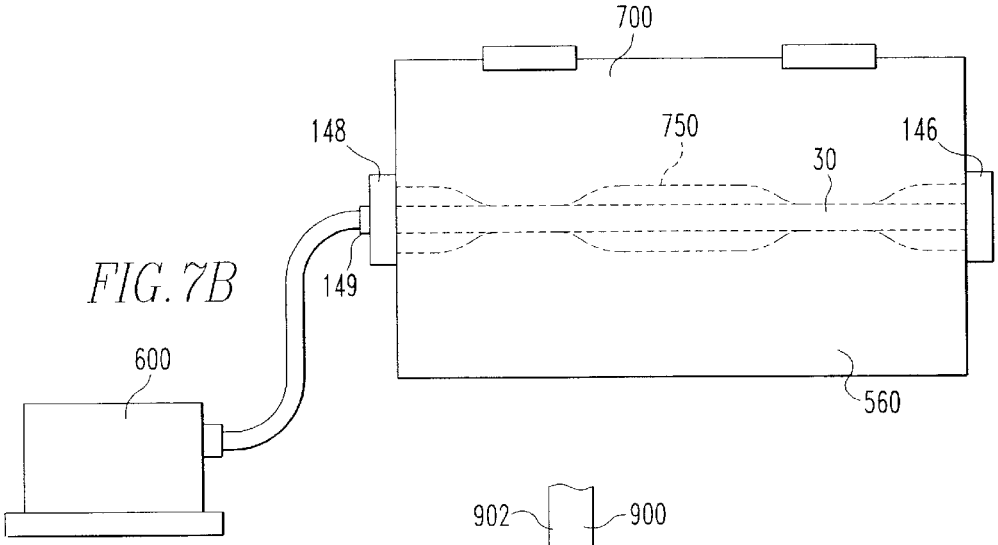
FIG. 7B also shows the tube disposed in a die/vacuum chamber.

This method may also be used to form expanded regions 140 having a shape other than a circumferential localized expansion 130. For example, as seen in FIG. 7A, during the preparation of the tube 30, a laser 800 may be used to anneal a local portion 840 of the tube 30. As used herein, a "local portion" is a relatively thin area, such as an arc of about ten degrees, extending, generally, in the axial direction. Following the annealing step, the tube 30 is sealed and a pump 600 is attached at the inlet valve 149. As with the embodiment shown in FIG. 6C, the tube 30 is then be placed in a vacuum chamber 550, having a die 560. Here the die cavity 562 corresponds to the desired ridge like shape for the expanded regions 140. As the pump 600 increases internal pressure, the vacuum chamber 550 reduces ambient pressure thus causing the annealed region 840 to expand.

Figure 8:
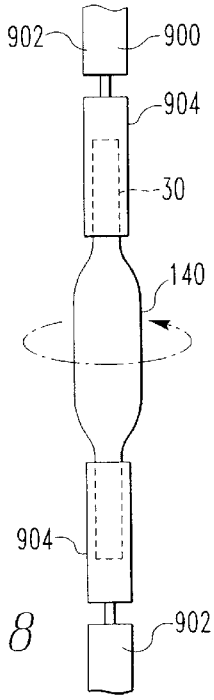
FIG. 8 is a schematic of the tube disposed in an axial centrifuge.

As shown in FIG. 8, the radial force used to expand the tube 30 may also be created by centrifugal force. That is, after the tube 30 is prepared, the plugs 146, 148 are attached to a axial rotating device 900 that spins the tube 30 about the longitudinal axis of the tube 30. The tube 30 would be attached to a rotating device 900, such as the electrical motors 902, using extended cuffs 904 so that only the soft first region 140*a* to be expanded would be exposed. That is, a cuff 904 is located on at least one side of the first region. The mass of the exposed tube 30 along with the mass of the material 201 within the tube 30, when rotated at high rpm and subjected to sufficient centrifugal forces causes the first region 140*a* to yield outwardly, forming an expanded region 140 in the tube 30.

While specific embodiments of the invention have been described in detail, it will be appreciated by those skilled in the art that various modifications and alternatives to those details could be developed in light of the overall teachings of the disclosure. For example, similar processing methods could be applied to geometries other than circular tubes 30 such as square tubes or rectangular tubes or even to items other than tubes such as spheres or boxes that could be locally heat treated and pressurized. Accordingly, the particular arrangements disclosed are meant to be illustrative only and not limiting as to the scope of invention which is to be given the full breadth of the claims appended and any and all equivalents thereof.

What is claimed is:

1. A method of expanding a portion of a tube comprising the steps of:

a. providing an elongated metal tube:

b. preparing an intermediate portion of said tube to be expanded by annealing a first region of said tube until said region is soft; plugging one end of said tube with a first plug; filling said tube with water; and plugging the other end of the tube with a second plug;

c. exerting a generally uniform outwardly radial force to create an expanded region by immersing said tube into cryogenic liquid until said water freezes and expands, said freezing and expanding of said water causing said region of said tube to expand;

d. thawing said tube; and e. emptying said water out of said tube.

2. The method of claim 1, wherein said steps immersing said tube in cryogenic liquid and thawing said tube are each repeated at least once after said initial thawing step to gradually form said expanded region of said tube while avoiding cracking said tube.

3. The method of claim 2, wherein said step of annealing a first region of said tube until said region is soft is repeated prior to each said step of increasing pressure.

4. A method of expanding a portion of a tube comprising the steps of:

a. providing an elongated metal tube;

b. preparing an intermediate portion of said tube to be expanded; and c. exerting a generally uniform outwardly radial force to create an expanded region by annealing a first region of said tube until said region is soft;

providing a mass of solid material having a coefficient of thermal expansion which is greater than the material used to form said tube, said mass structured to fit snugly within said tube inserting said mass of solid material into said tube until said mass is within said first region; and applying heat to said first region.

5. The method of claim 4, wherein said step of exerting force includes the steps of:

a. enclosing said tube in a vacuum chamber; and b. depressurizing said vacuum chamber.

6. The method of claim 4, wherein said step of providing a mass of solid material includes the step of providing a bimetal.

7. A method of expanding a portion of a tube comprising the steps of:

a. providing an elongated metal tube having a first coefficient of thermal expansion;

b. annealing a first region of said tube until said region is soft;

b. inserting a material into said tube, said material having a second coefficient of thermal expansion greater than said first coefficient of thermal expansion; and c. heating said material to exert a generally uniform outwardly radial force to create an expanded region.

8. A method of making a vibration resistant core for a catalytic combustor module comprising the steps of:

a. providing a tube sheet, an inner shell, an inner wall, two side walls, and a plurality of cooling tubes;

b. preparing an intermediate portion of said tube to be expanded;

c. coupling each said tube to said tube sheet;

d. coupling said inner shell, inner wall, and two side walls to said tube sheet;

e. exerting a generally uniform outwardly radial force to create an expanded region.

9. The method of claim 8, wherein said preparation step includes a. annealing a first region of each said tube until said region is soft;

b. plugging one end of each said tube with a first plug;

c. filling each said tube with water; and d. plugging the other end of the tube with a second plug.

10. The method of claim 9, wherein said step of exerting force includes the steps of:

a. immersing said tube into cryogenic liquid until said water freezes and expands, causing said region of said tube to expand until said expanded region contacts another tube, said inner shell, said inner wall, or a side wall;

b. thawing said tube; and c. emptying said fluid out of said tube.

11. The method of claim 10, wherein said steps of immersing said tube in cryogenic liquid and thawing said tube are each repeated at least once after said initial thawing step to gradually form said expanded portion of said tube while avoiding cracking said tube.

* * * * *